United States Patent [19]

Doubleday et al.

[11] 3,945,602

[45] Mar. 23, 1976

[54] GANG TIE HOLDING BOLT

[75] Inventors: Max Doubleday, Hackensack, N.J.; Douglas M. Demarest, Port Washington, N.Y.

[73] Assignee: Harsco Corporation, Harrisburg, Pa.

[22] Filed: Sept. 10, 1974

[21] Appl. No.: 504,732

[52] U.S. Cl. ..... 249/219 R; 249/44; 249/190

[51] Int. Cl.[2] ..... E04G 17/04

[58] Field of Search ..... 249/40–41, 249/43–47, 190–191, 213–214, 216–217, 219 R, 219 W

[56] References Cited

UNITED STATES PATENTS

| | | | |
|---|---|---|---|
| 2,102,717 | 12/1937 | Jennings | 249/219 R |
| 3,067,479 | 12/1962 | Schimmel | 249/41 |
| 3,142,883 | 8/1964 | Kort et al. | 249/45 |
| 3,584,827 | 6/1971 | Shoemaker | 249/45 |
| 3,655,162 | 4/1972 | Shoemaker | 249/219 W |
| 3,756,555 | 9/1973 | Doubleday et al. | 249/191 |

FOREIGN PATENTS OR APPLICATIONS

| | | | |
|---|---|---|---|
| 1,052,664 | 3/1959 | Germany | 249/219 W |

*Primary Examiner*—Francis S. Husar
*Assistant Examiner*—John McQuade
*Attorney, Agent, or Firm*—Cameron, Kerkam, Sutton, Stowell & Stowell

[57] ABSTRACT

A gang tie holding bolt holding tie rods of multiple panel units in gang form sections for pouring concrete has a folded over body portion with two spaced parallel flanges from one of which a finger is formed to extend through adjacent frame members of adjacent panel units, the other flange being cut away opposite the finger. Spaced from this finger is a hole through both flanges to receive a key. The tie rod passed between the flanges and the loop in the end of the tie rod receives the key to hold the bolt and tie rod in position. The shoulders formed on the two flanges by the cut away portions thereof engage the outer faces of adjacent frame members to prevent tipping of the bolt thus locking the panel units more securely together.

1 Claim, 6 Drawing Figures

GANG TIE HOLDING BOLT

BACKGROUND OF THE INVENTION

The use of prefabricated panels in a gang of formed sections either preassembled or assembled on the job is well known in the concrete pouring art. Such prefabricated units usually have a flat face of plywood or other suitable material of appropriate dimensions reinforced by a metal frame extending around the periphery of each unit. The metal frame is usually of H-shape cross-section and edges thereof abut when the panel units are in position. These edges are suitably cut away to provide space for the insertion of tie rods to extend between spaced gang form sections between which the concrete is to be poured. The tie rods prevent the weight of the concrete from forcing the gang form sections away from each other.

Gang form bolts for locking adjacent sections together and for holding the looped ends of the tie rods have heretofore been proposed and their use described as in U.S. Pat. No. 3,067,479, granted Dec. 11, 1962, to V. R. Schimmel and entitled Panel-Securing Tie Rod Anchor Bolt With Offset Anchor Point and in U.S. Pat. No. 3,756,555 granted Sept. 4, 1973 to Max Doubleday et al.

SUMMARY OF THE INVENTION

A gang tie holding bolt comprises a folded over body portion with two spaced parallel flanges, from one of which a finger is formed extending from one end of the body portion to pass through slots in adjacent frame members of panel units, an opening in said flanges spaced from said finger, a tie rod passing between said flanges and having a looped end adjacent said opening, a metallic key passing through said opening and through said loop to hold the bolt in place and prevent the looped end of the tie rod from leaving the bolt.

BRIEF DESCRIPTION OF THE DRAWINGS

In the accompanying drawings, in which like reference characters indicate like parts.

DESCRIPTION OF THE PREFERRED EMBODIMENT

Figure 1:
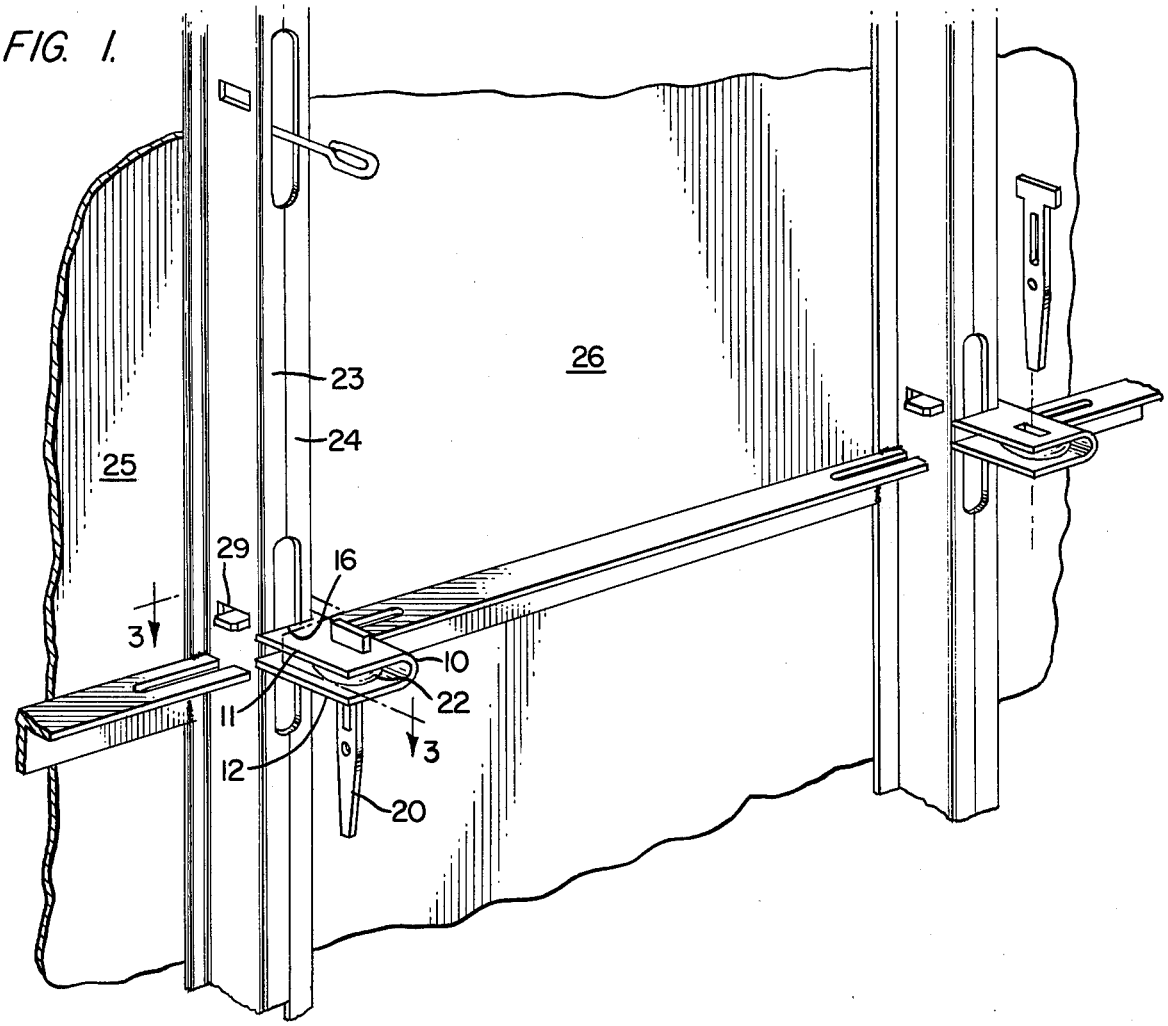
FIG. 1 is a perspective view of a gang tie holding bolt of the present concept showing the relationship of the body portion to the extending finger, frame members of adjacent panel units and tie rod holding key.
Figure 2:
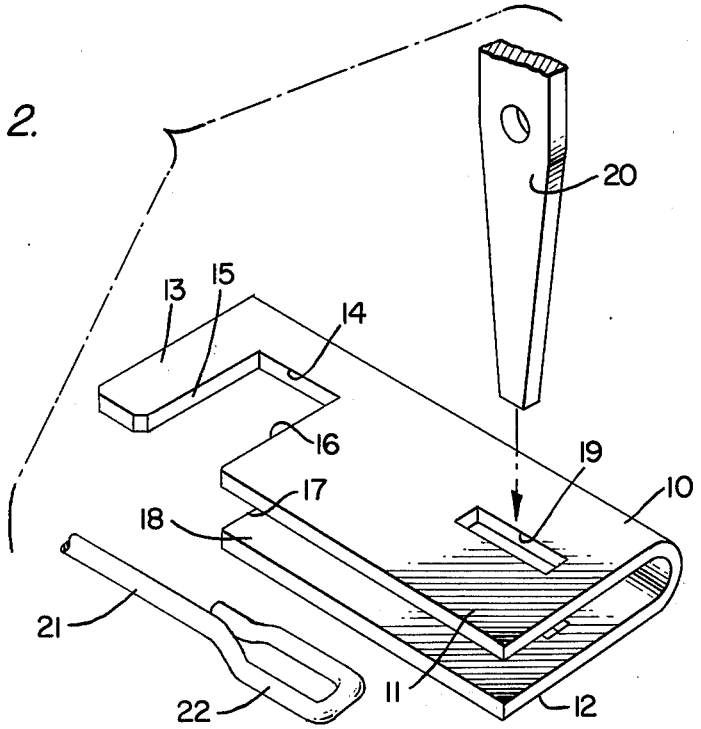
FIG. 2 is a perspective view from the embodiment of FIG. 1.

As seen in FIGS. 1 and 2, the tie rod bolt has a folded over body portion 10 having spaced parallel flanges 11 and 12 with flange 11 provided with a finger 13 extending in the principal plane thereof and formed by a cut away portion 14 providing shoulders 15 and 16. Flange 12 is cut away at 17 to provide a shoulder 18 parallel to shoulder 16. An opening 19 extends through flanges 11 and 12 to receive key 20. Tie rod 21 having a looped end 22 is received between flanges 11 and 12 and key 20 then passes through loop 22.

Figure 3:
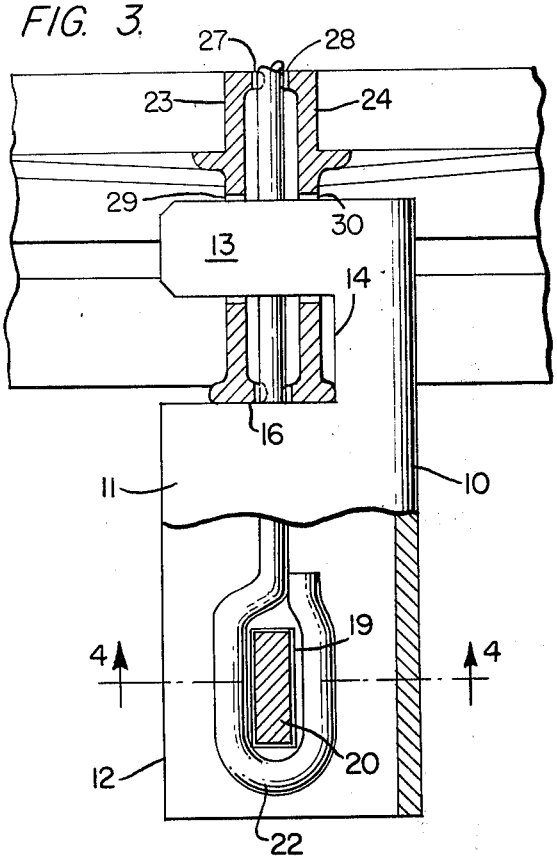
FIG. 3 is a view partially in section from above of the embodiment of FIG. 1 on the line 3—3, shown in position for insertion from right to left through adjacent frame members of adjacent panels showing the position of the tie rod loop and key therethrough.
Figure 4:
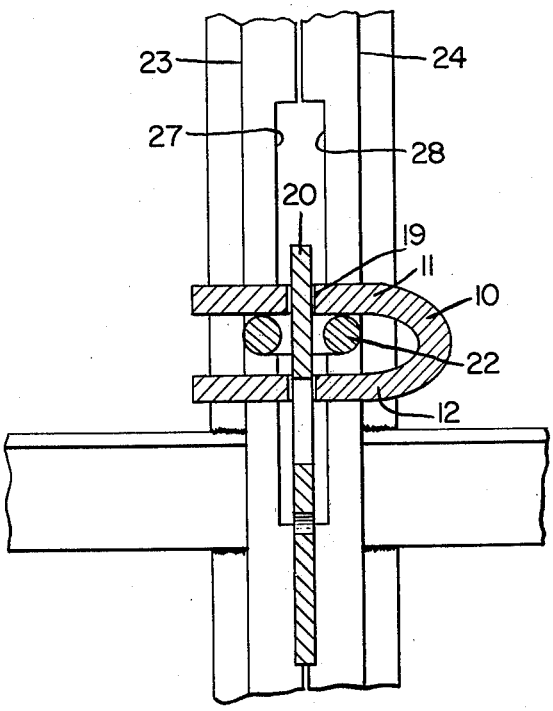
FIG. 4 is a sectional view of the bolt of FIG. 3 on the line 4—4 thereof.
Figure 5:
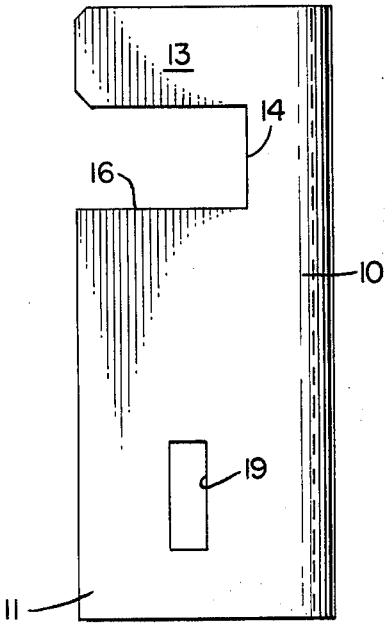
FIG. 5 is a view from above of the bolt of FIG. 3 in position for movement from right to left into position to receive the tie rod.

Referring now to FIGS. 3 and 5, the tie bolt there being disposed for insertion from right to left through frames 23 and 24 of panels 25 and 26, respectively, frames 23 and 24 being provided in known manner, with half slots or openings 27 and 28, respectively, to receive a tie rod 21 and its conventional looped end 22. Frames 23 and 24 are also provided with mating opening 29 and 30 respectively, in known manner to receive finger 13 of the bolt.

The tie bolt is held with finger 13 facing up and finger 13 is entered in openings 29 and 30. The tie bolt is moved to the left until loop 22 passes unto alignment with opening 19, the flat portion of the loop being disposed between flanges 11 and 12. Key 20 is then inserted through opening 19 to hold the bolt and tie rod together and in position so that key 20 cannot disengage from loop 22 and finger 13 disengage from frames 23 and 24, the adjacent flange of frame 24 fitting into slot 14. Shoulders 16 and 18 engage the outer faces of frames 23 and 24 to prevent tipping of the bolt.

Figure 6:
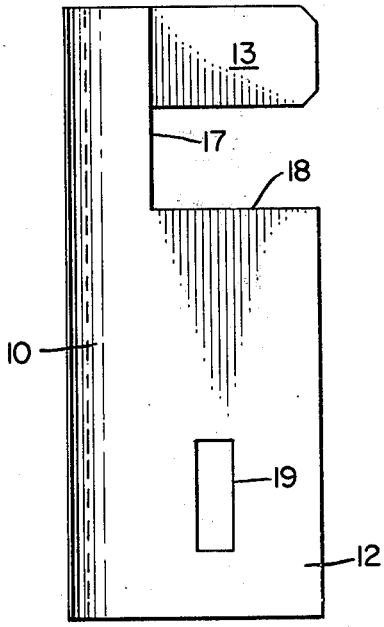
FIG. 6 is a view from above of the bolt of FIG. 3 with the bolt in position for movement from left to right to engage in the frames of adjacent panels and to receive the tie rod.

Referring now to FIG. 6, the tie bolt is to be inserted through openings 29 and 30 of frames 23 and 24 from left to right. In this case the bolt is held with finger 13 down and finger 13 is slid into openings 29 and 30 until loop 22 enters between flanges 11 and 12 and is aligned with opening 19. Key 20 is then entered through opening 19 to hold the elements in position, as above, and the adjacent flange of frame 23 enters slot 14.

The tie bolt does not function to lock frames 18 and 19 together, this being done by conventional wedge bolts, not shown.

Variations to the above-described preferred embodiment of the present invention may be made without departing from the inventive concept. Reference should therefore be had to the appended claims to determine the scope of this invention.

We claim:

1. An elongated gang tie holding bolt for holding a tie rod having a looped end adapted to pass through abutting frames of prefabricated panel units, the frames having mating slots, comprising a body portion folded along a longitudinal axis thereof, two spaced parallel longitudinal flanges for said body portion, a finger extending from an end of one of said flanges adapted for entry through the mating slots, a cut away portion in the other of said flanges opposite said finger, parallel shoulders on said flanges adapted to engage the adjacent faces of the frames, an opening through said flanges away from said finger, the tie rod adapted to pass between said flanges and the looped end being aligned with said opening, a key adapted to pass through said opening and through the looped end for holding the tie rod in said bolt and for holding said finger in the mating slots and a slot in said one of said flanges containing said finger adapted to receive a portion of the adjacent one of the frames.

* * * * *